United States Patent [19]

Seehase

[11] 4,162,791

[45] Jul. 31, 1979

[54] TENNIS RACQUET HAVING RADIALLY ARRAYED STRINGS

[76] Inventor: Jack C. Seehase, 1200 Osceola Ave., Winter Park, Fla. 32789

[21] Appl. No.: 844,026

[22] Filed: Oct. 20, 1977

[51] Int. Cl.[2] ..... A63B 51/00

[52] U.S. Cl. ..... 273/73 D

[58] Field of Search ..... 273/29 A, 67 R, 73 R, 273/73 C, 73 D, 73 E, 73 F, 73 H, 96 R, 96 D

[56] References Cited

U.S. PATENT DOCUMENTS

| | | | |
|---|---|---|---|
| 1,866,158 | 7/1932 | Goodwin | 273/96 R |
| 2,369,145 | 2/1945 | Kent | 273/73 R |
| 3,834,699 | 9/1974 | Pass | 273/73 D |
| 3,992,008 | 11/1976 | Watkin | 273/67 R X |
| 4,026,553 | 5/1977 | Vendramini | 273/73 D X |
| 4,047,717 | 9/1977 | DeAngelis | 273/96 R X |

FOREIGN PATENT DOCUMENTS

| | | | |
|---|---|---|---|
| 981444 | 1/1951 | France | 273/73 D |
| 11965 | of 1911 | United Kingdom | 273/73 D |
| 204113 | 9/1923 | United Kingdom | 273/73 L |
| 237395 | 7/1925 | United Kingdom | 273/73 D |

*Primary Examiner*—Richard J. Apley
*Attorney, Agent, or Firm*—Julian C. Renfro

[57] ABSTRACT

A novel tennis racquet wherein the frame of the racquet is strung with radially arrayed strings, with the inner end of each of such strings passing through and around a comparatively small ring forming the central terminus for the radially-arrayed strings. Although only a single central securing ring may be utilized if desired, in some instances I have found it advantageous to also utilize a second ring of somewhat larger diameter, concentric with the first ring. This larger diameter ring provides a turn-around point for every other radially-arrayed string, and advantageously makes it conveniently possible to maintain an effective spacing of the strings in the outer locations, near where they attach to the frame. This latter construction enables the avoidance of an excessively high number of strings needing to pass through and around the central securing ring.

11 Claims, 7 Drawing Figures

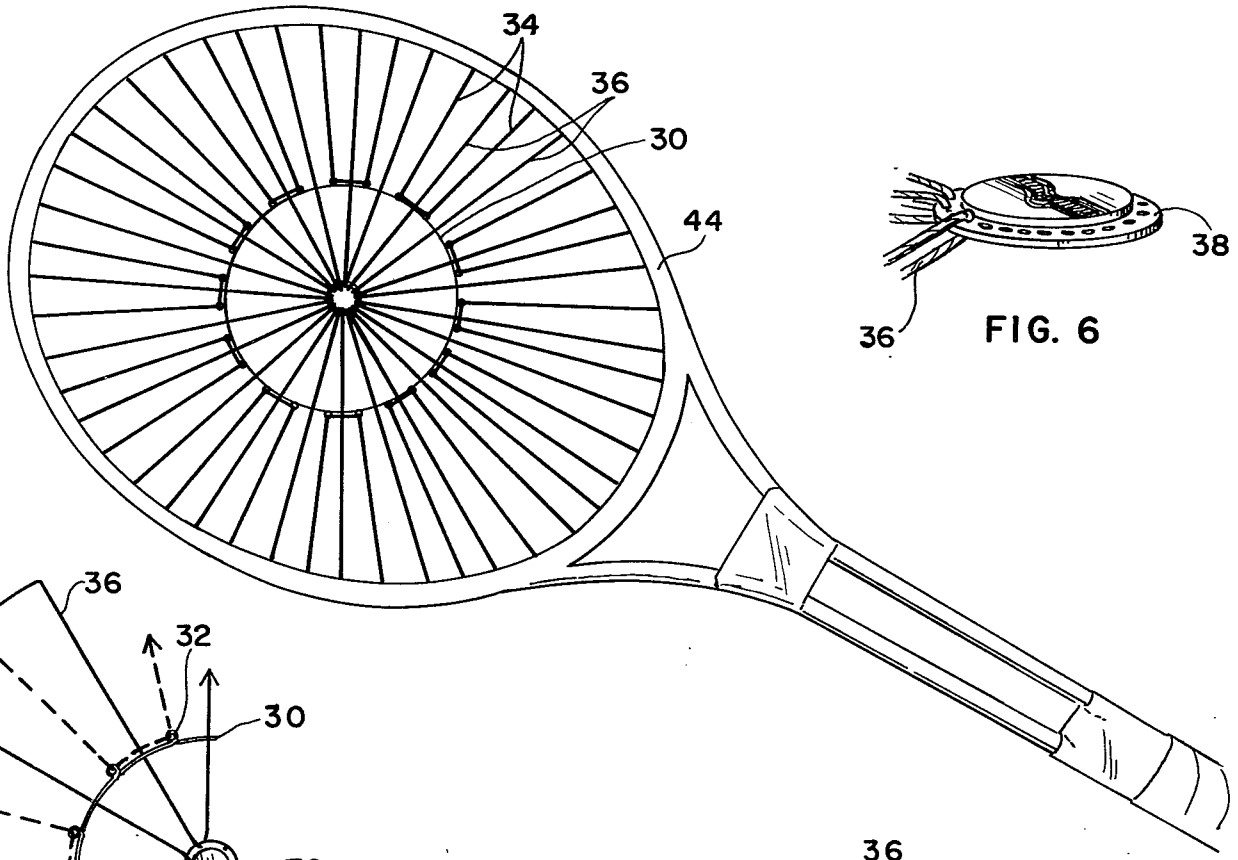
FIG. 4
FIG. 6
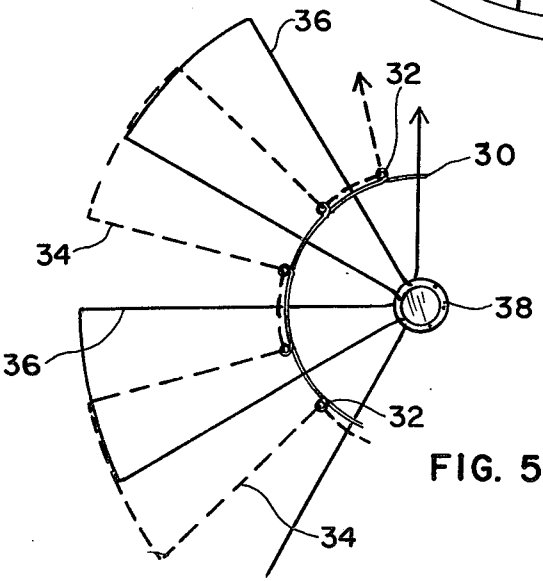
FIG. 5
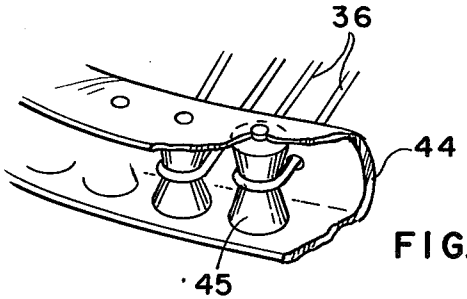
FIG. 7

TENNIS RACQUET HAVING RADIALLY ARRAYED STRINGS

BACKGROUND OF THE INVENTION

As is well known, the conventional type of tennis racquet is strung in a rectilinear or x-y configuration, with numerous strings being parallel to each other, and perpendicular to a parallel array of vertically disposed strings. The horizontal and vertical strings define an open mesh in which substantially all of the holes are square.

Because the head of the conventional racquet is oval, only three or four horizontal strings and only three or four vertical strings are full length strings extending across the racquet frame. The area bounded by these full length strings is often referred to as the "sweet spot" by the tennis buff.

A dynamic analysis has shown that regardless of where the ball is struck with a conventional racquet, only three or four strings in each direction transfer the shock load of the rapidly moving ball to the frame, and the frame is caused to deflect inward at these four locations where the strings are anchored. This inward deflection of these frame portions necessarily brings about a relaxing of the initial tension applied to these strings, and the other strings of the racquet not only fail to compensate for this, but also if anything they contribute to such condition because of their preload.

Another consequence of having a racquet strung in the conventional rectilinear manner is that the farther away from the center of the racquet that the ball is struck, the shorter the effective length of the strings, and this causes a faster response of the shock from the racquet to the player's arm. It is therefore apparent that if all of the strings of the racquet could react equally, such would minimize the shock to a player's arm.

SUMMARY OF THIS INVENTION

In accordance with this invention, I have provided a novel radially strung racquet wherein advantageously, all of the strings react across the entire cross section of the racquet frame substantially equally. A dynamic analysis of this new racquet reveals a unique type of load path comparable to the spokes and rim of a bicycle wheel. Regardless of where on the racquet face, the impact of a ball with the strings occurs, the strings involved transfer the load to the frame at two diametrically opposite points. If, in fact, the frame would tend to deflect inwardly at these points, it is important to realize that the portions of the frame orthogonal to those two opposed points would tend to deflect outwardly, and inasmuch as the radial strings extend around the full circumference of the racquet, any consequential distortion of the frame is prevented in much the way that the spokes of a bicycle wheel that are at a given instant horizontally arrayed, serve to prevent the part of the wheel in contact with the ground from bowing inwardly or upwardly.

With regard to the comfort of the player, the strings of my racquet may be strung with say an initial 50 pound tension force, with all of the strings of the racquet reacting over their full length regardless of the location of the impact point of the ball on the strings. This means a slower response to the shock of the ball impact being transmitted to the player's arm, for the longer the length of the strings involved, the slower the response time with respect to the shock.

An additional advantage of my novel radial string array is the fact that the comparatively long, spoke-like strings tend to deflect upon ball contact, with these deflected strings conforming to the outer surface of the ball so effectively as to greatly enhance the player's ability to add spin to a ball being returned.

OBJECTS

It is the primary object of this invention to provide a radially strung tennis racquet wherein the so-called sweet spot is considerably increased with respect to the size of the comparable spot in a conventional racquet.

Another object of this invention is to provide a novel, radially strung tennis racquet wherein all of the strings are of substantially the same length, thus increasing the area of the sweet spot.

It is still another object of this invention to provide a novel tennis racquet configuration wherein the radially strung configuration decreases the tendency of the racquet to twist in a player's hand when striking the ball.

It is yet another object of this invention to provide a novel racquet frame having low friction string suspension means aiding the tensioning of the strings of the racquet.

It is still another object of this invention to provide a novel radially strung racquet arrangement wherein strings of long length and of short length are interspersed.

It is yet still another object of this invention to provide a radially strung tennis racquet whose configuration makes it possible to increase the spin that may be given to the ball by the player.

These and other objects, features and advantages of my novel racquet will be more apparent as the description proceeds.

THE FIGURES OF DRAWING

FIG. 4 is a plan view of a second embodiment of my racquet illustrating the use of two concentric rings upon which the inner ends of alternating long and short radial strings are supported;

FIG. 5 is a somewhat simplified view of the embodiment of FIG. 4, with this figure revealing the use of large diameter and small diameter means upon which the inner ends of the strings are supported;

FIG. 6 is a somewhat enlarged view of an alternate form of central string support means; and FIG. 7 is a fragmentary view showing of a novel racquet construction wherein an alternate form of low friction support means is utilized.

DETAILED DESCRIPTION

Figure 1:
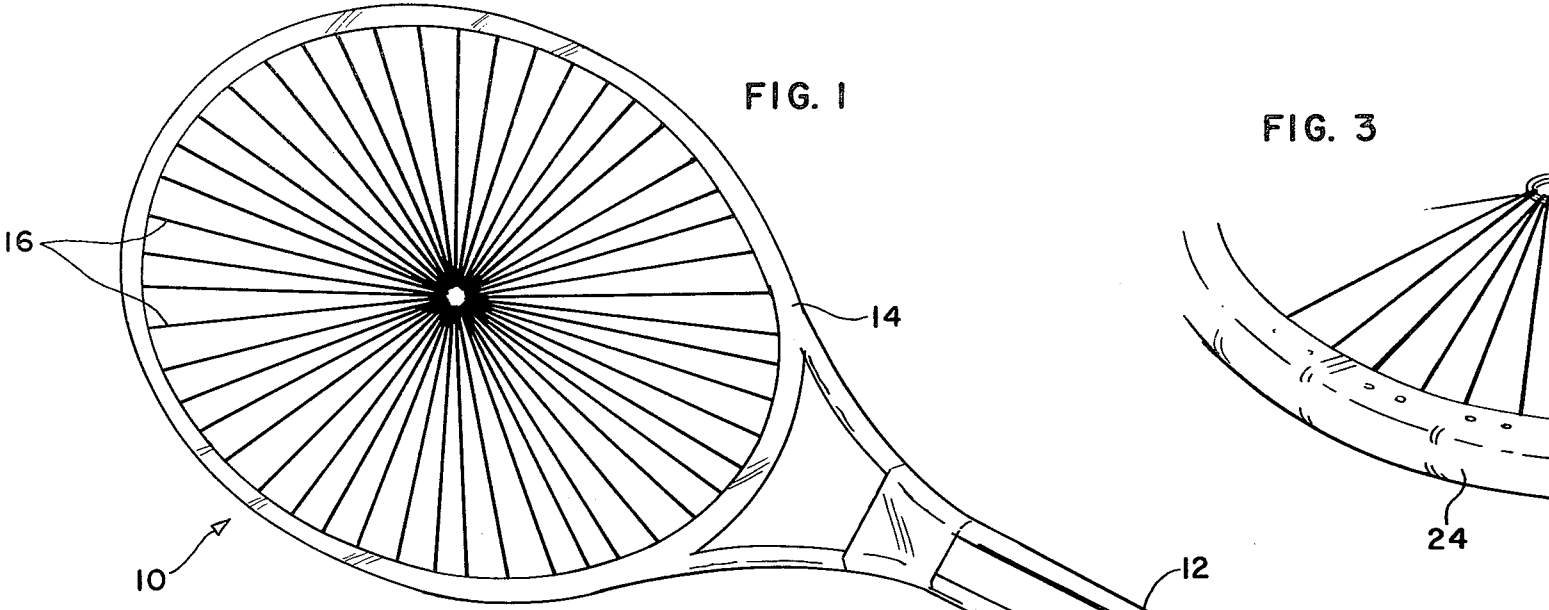
FIG. 1 is a plan view of a novel, radially strung tennis racquet in accordance with a first embodiment of my invention.

Turning to FIG. 1, it will there be seen that I have illustrated a typical form of tennis racquet utilizing my novel radially strung technique. Racquet 10 is equipped with a handle 12 and head 14, with the strings 16 of the head being unlike that of any previously known racquet, in that the strings are radially disposed in a single common plane.

Figure 2:
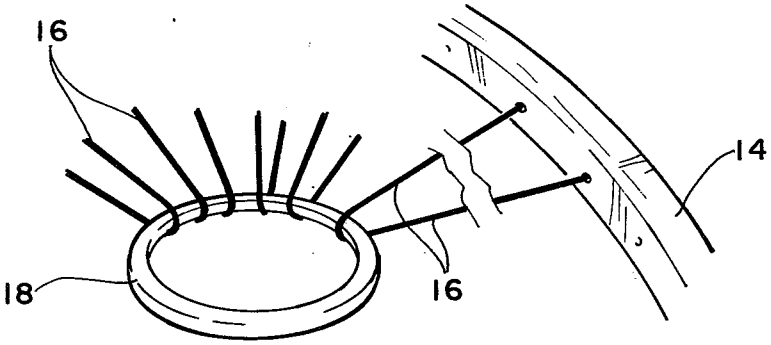
FIG. 2 is a fragmentary view to a slightly larger scale in order to show the use of a central annulus or ring upon which the inner ends of the radially-arrayed strings are supported.

A first embodiment of my invention involves the utilization of a central ring or annulus 18, shown in FIG. 2 to a larger scale. In accordance with the embodiment of FIGS. 1 and 2, a given string passing through a small hole in the frame of the head extends toward the center of the racquet, where it passes through and around the annulus 18 before returning to pass through a small hole in the frame adjacent the first mentioned hole. The string then may pass along the outside of the frame to the location of the next small hole, at which time it extends inwardly to pass again around the ring 18, then outwardly to the frame, and so forth.

It is important to note that herein from time to time I refer for the sake of convenience to a string extending between the ring 18 and the frame as if it were a single string, but in reality, I typically accomplish a radial stringing of the entire racquet using a single continuous string of substantial length, or possibly two strings. The strings and the racquet frame in this embodiment may be substantially conventional components, with the strings of say nylon, gut, or the like, and the frame of wood, metal, fiberglas, or other suitable material.

Figure 3:
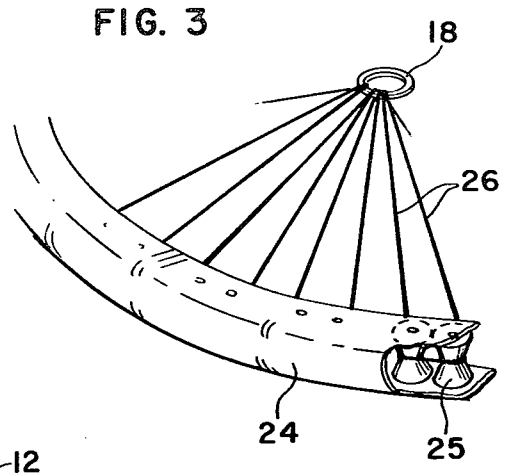
FIG. 3 is a fragmentary view showing, in more detail, a form of string support arrangement for the radial strings, which minimizes friction, and enables the ready tensioning of the strings.

I have found that it is possible to achieve greater string tautness as well as longer string life if I cause the radially outward string ends to pass around curved, roller-like components properly spaced around the racquet frame. As shown in FIG. 3, I may construct a racquet frame 24 having a U-shaped cross section, with slightly hourglass shaped pins 25, such as of nylon or other naturally slick material disposed at spaced intervals along the interior of the frame. These pins 25 are typically mounted on rivets whose outer ends are substantially flush with the exterior surface of the frame. As shown in FIG. 3, I may cause each string to pass around a pair of pins if a wide spacing of the strings is appropriate, or only around a single pin if the strings are to reside close together. I have found that the riveting of the pins in position around the frame in effect causes the establishment of a high strength box section, which resists undesirable bending and distortion quite effectively.

Although the pins 25 may tend to turn as the strings 26 are pulled tight during the stringing process, rotation is not mandatory in view of the inherent slickness of the material chosen for their construction. As is obvious, the reduced diameter of the central portions of the pins 25 tends to cause all the strings 26 to be held in a common plane.

Turning to FIG. 4, I have there revealed an embodiment in which a second annular ring 30 is utilized, with this ring being concentric with ring 18, and of substantially larger diameter. The reason I use this second ring in this embodiment of my invention is that it makes it conveniently possible to group the strings located at the outer periphery of the racquet more closely together than would be possible if the radially inner portion of every string needed to pass through and around the small central annulus 18 of the embodiment of FIG. 1.

As shown in FIG. 4 and in greater detail in FIG. 5, a number of small loops 32 can be utilized at appropriate intervals about the outer periphery of the outer ring 30. Although the comparatively short strings 34 located about the outer periphery of the racquet, and shown in dashed lines in FIG. 5 could pass through and around the larger ring 30 in much the manner of the full length strings passing through and around the smaller ring 18, I prefer the use of the loops 32 in that the shorter strings cannot at any time shift radially in an undesirable fashion. I prefer for the short strings to be used in an alternating array with the longer strings, as shown in those figures.

Although the larger ring 30 could be made of comparatively sturdy material, this is usually not necessary, and I have found it appropriate to create the larger ring out of stainless steel wire approximately 0.030 inch in diameter, with the loops 32 being integrally formed in spaced locations about its periphery.

In the embodiment of my invention, revealed in FIGS. 4 and 5, a central ring identical to the ring 18 of the first embodiment may be used in connection with the inner portions of full length strings 36, but I prefer to use a central member 38 of comparatively small diameter, around the periphery of which a number of small string-receiving holes are provided at proper intervals. The central member 38 is preferably made of metal, and as revealed in FIG. 6, it may incorporate a raised section approximately the thickness of a string on each of its outer faces. By having this slightly raised section on each of its sides, a playing surface the same height as the surface defined by the strings is assured.

The central member 38 may prominently display a brand name, trade name, model number, owner's name, decoration, or the like.

Although no particular manner of threading is mandatory, in the embodiment of FIG. 5 I prefer to use a single string that passes from the frame to the small ring 38, thence back to the frame and so forth in order to form the longer strings 36. The shorter strings 34 are preferably created by the use of a second string that extends between the frame of the racquet and the loops 32 of the larger ring in interspersed relationship with the longer strings, as shown in this figure. Although such is not required, I prefer for every other longer string to be on one side of the larger ring 30, and the alternate longer strings to be on the opposite side thereof.

As will be appreciated, this construction has many characteristics in common with the wheel of a bicycle, wherein spokes weak in compression are used, but because of the tensioning of the spoke assembly, a very sturdy construction is created.

In FIG. 7 I reveal a section of racquet frame 44 differing from the embodiment of FIG. 3 in that the open portion of this member of U-shaped cross-section is outwardly disposed instead of being inwardly disposed. The strings 36 may curve around single rollers or pins 45 as shown, or as in the case of FIG. 3, each string may pass around an adjacent pair of such pins. Small holes appropriately placed in the base portion of the U-shaped cross section of frame 44 permit the passage through of the strings 36 leading to and from the centrally-disposed string supporting member.

As should now be apparent, a number of different embodiments of radially-strung tennis racquets within the scope of this invention may be constructed, which includes racquets with strings all essentially the same length; alternating strings of long and short length; racquets of wood; racquets of metal; racquets of metal with low-friction mounting means, and the like. In all instances, my novel radially strung racquets make it possible for amateur and champion alike to be able to considerably improve their tennis skills.

Of particular importance is the fact that in my novel radial string array, no substantial number of squares or rectangles are created, as in the case of a conventional racquet, and because of the free length of the radial strings, they are able to readily conform to the outer surface of a struck tennis ball, and because of increased ball contact, to enable the player to readily apply a desired amount of spin to the ball.

I claim:

1. A racquet comprising a head of generally oval shape, said head being strung with a plurality of tensioned strings extending radially inwardly from a frame forming a closed loop, and a central ring of small size disposed approximately in the center of the string array, with at least some of the radially arrayed strings extending through and around said central ring, said central ring being smaller than the ball to be used with said racquet, and together with said string array forming an effective, substantially planar striking surface.

2. The racquet as defined in claim 1 wherein a second, larger diameter ring concentric with the first ring is also utilized for securing strings of the racquet, with strings of less length extending between the frame and the larger ring than the the length of the strings extending between the frame and the smaller ring.

3. The racquet as defined in claim 2 in which the strings attached at their outer locations to the frame, are alternately long and short strings.

4. The racquet as defined in claim 1 wherein said ring has an internal circumference such that said strings will each have direct contact with the inner periphery of said ring, and thus avoid double string thickness in the vicinity of said ring.

5. A tennis racquet having a frame of metal of U-shaped cross-section, said frame forming a head of generally oval shape, said head being strung with a plurality of tensioned, radially-disposed strings, with a central ring of small size disposed approximately in the center of the string array, with at least some of the radially arrayed strings extending through and around said central ring, thus to form a substantially planar striking surface, and pin means forming low friction string supporting means, said pin means being disposed in said frame of U-shaped cross section at spaced locations, and forming the outer supports for the radially-disposed strings.

6. The tennis racquet as defined in claim 5 in which the base portion of said U-shaped member of which the frame is constructed is directed outwardly.

7. The tennis racquet as defined in claim 5 in which the base portion of said U-shaped member of which the frame is constructed is directed inwardly.

8. The tennis racquet as defined in claim 5 wherein a second, larger diameter ring concentric with the first ring is also utilized for securing strings of the racquet, with strings of less length extending between the frame and the larger ring, than the length of the strings extending between the frame and the smaller ring, and with the strings at their attachment points on the frame being alternately long strings and short strings.

9. The tennis racquet as defined in claim 8 in which small loops are disposed at spaced locations about the periphery of said larger diameter ring, to serve as anchor points for short strings.

10. The racquet as defined in claim 5 wherein said ring has an internal circumference such that said strings will each have direct contact with the inner periphery of said ring, and thus avoid double string thickness in the vicinity of said ring.

11. A racquet comprising a head of generally oval shape, said head being strung with a plurality of strings extending radially inwardly from a frame forming a closed loop, and a central ring of small size disposed approximately in the center of the head, with at least some of the radially arrayed strings extending under tension through and around said central ring, said ring having an internal circumference such that said strings will each have direct contact with the inner periphery of the ring, and thus avoid double string thickness in the vicinity of the ring, said string array forming a substantially planar striking surface.

* * * * *